United States Patent [19]

Chaudhry et al.

[11] 4,380,335

[45] Apr. 19, 1983

[54] PINBALL GAME APPARATUS

[75] Inventors: Jagdish C. Chaudhry; Lorena F. Chaudhry, both of Los Altos, Calif.

[73] Assignee: Michael Wichinsky, Las Vegas, Nev.

[21] Appl. No.: 972,954

[22] Filed: Dec. 26, 1978

Related U.S. Application Data

[63] Continuation-in-part of Ser. No. 933,069, Aug. 11, 1978, abandoned.

[51] Int. Cl.[3] ..... A63F 7/02

[52] U.S. Cl. ..... 273/121 A; 273/129 V

[58] Field of Search ..... 273/85 A, 118 R, 118 A, 273/119 R, 119 A, 121 R, 121 A, 122 R, 122 A, 127 R, 127 B, 127 C, DIG. 31, 129 V, 129 W, 142 B

[56] References Cited

U.S. PATENT DOCUMENTS

| | | | |
|---|---|---|---|
| 514,688 | 2/1894 | Starks | 273/118 R |
| 1,537,236 | 5/1925 | Jarvis | 273/119 R |
| 2,150,515 | 3/1939 | Meyer | 273/119 R |
| 2,589,839 | 3/1952 | McFerran | 273/121 R |
| 3,119,620 | 1/1964 | Peterson | 273/121 R |
| 3,582,074 | 6/1971 | Menotti | 273/121 A X |
| 3,675,927 | 7/1972 | Gottlieb et al. | 273/119 A |
| 3,840,235 | 10/1974 | Breslow | 273/119 A |
| 3,853,324 | 12/1974 | Reiner et al. | 273/119 A |
| 3,910,580 | 10/1975 | Leonhart | 273/119 A |
| 4,046,380 | 9/1977 | Goldfarb et al. | 273/119 R |
| 4,093,232 | 6/1978 | Nutting et al. | 273/121 A |

FOREIGN PATENT DOCUMENTS

| | | | |
|---|---|---|---|
| 1080657 | 6/1954 | France | 273/119 R |
| 1098462 | 3/1955 | France | 273/119 R |
| 1373806 | 8/1964 | France | 273/121 A |
| 1489138 | 3/1967 | France | 273/119 R |
| 585246 | 11/1958 | Italy | 273/119 A |
| 52-17933 | 2/1977 | Japan | 273/138 A |

OTHER PUBLICATIONS

*Marx Catalog;* Received Apr. 5, 1977; pp. 28, 32–35.

*Electronics Australia;* "An Electronic Roulette Wheel"; Feb. 1976; pp. 46–51.

*Primary Examiner*—Vance Y. Hum

*Attorney, Agent, or Firm*—Claude A. S. Hamrick

[57] ABSTRACT

A pinball type game including an oval-shaped playing field having two or more flipper-equipped, player-goal positions disposed on opposite sides of the field and having score accumulating switches disposed around the perimeter of the field such that as a ball is caused to roll around the perimeter, the game monitoring electronics will accumulate score until one player or the other causes the ball to pass into the goal of his opponent. At that time the accumulated score is awarded to the scoring player. The playing field is generally dome-shaped so as to slope from the middle toward the goal positions and is decorated to resemble a roulette wheel.

13 Claims, 9 Drawing Figures

PINBALL GAME APPARATUS

CROSS REFERENCE TO RELATED APPLICATION

This application is a continuation-in-part of our copending application, Ser. No. 933,069, filed Aug. 11, 1978, now abandoned,

BACKGROUND OF THE INVENTION

1. Field of the Invention

The present invention relates generally to pinball type games and more particularly to a novel gaming device including a generally oval-shaped playing field having simulated roulette wheel decoration with scoring contacts arranged around the perimeter and goals disposed on opposite sides thereof.

2. Description of the Prior Art

Numerous pinball type games have heretofore been developed in which a small steel ball is projected to the top of a sloped playing surface and allowed to roll under the influence of its own weight downwardly through an array of bumpers, switches, flippers, etc., with button-controlled switches being provided to allow player interaction with the course taken by the ball until it is eventually lost to a receptacle in the playing field or along one edge thereof. Most such games, however, are desgined for single player operation and are not particularly well suited for simultaneous competitive play between several players.

Those games which are designed to allow competitive play ordinarily include a rectangular-shaped playing field having a number of either manually or electrically operated obstacles or flippers arrayed alternately over the length of the playing field with goals at each end, and the game is played in a manner similar to soccer. Although such games are interesting to play, they rarely involve skillful manipulation of flippers to accomplish anything other than driving a ball into the opponent's goal. Examples of such games are disclosed in the following U.S. Pat. Nos.: Meyer, 2,150,515; Henderson, 2,237,486; Burch, 3,064,978; Gottlieb et al, 3,675,927; Leonhart, 3,910,580; and Goldfarb et al, 4,046,380. Also of interest is game disclosed in French Patent No. 1,373,806.

SUMMARY OF THE PRESENT INVENTION

It is therefore a primary objective of the present invention to provide a novel competition-oriented pinball type game which involves more than just goal making in determining score.

Another object of the present invention is to provide a novel pinball type game in which points are accumulated by skillful ball control and such points are ultimately credited to the player who is able to drive the ball into the goal area of his opponent.

Still another object of the present invention is to provide a pinball type game which is relatively simple in construction yet can be played at all levels of skill.

Briefly, a preferred embodiment of the present invention include an oval-shaped playing field having two or more flipper-equipped, player-goal positions disposed on opposite sides of the field and having score accumulating switches disposed around the perimeter of the field such that as a ball is caused to roll around the perimeter, it will accumulate score until one player or the other causes the ball to pass into the goal of his opponent. The playing field is generally dome-shaped and slopes from the middle toward the goal positions. The playing field surface is decorated to resemble a roulette wheel.

A principal advantage of the present invention is that it provides a novel game device which can be played by one or more players of any skill level with the player(s) competing against either an included computer or the other playing opponent(s).

Another advantage of the present invention is that it incorporates electronic circuitry which, in addition to accumulating score and sometimes actively playing, also effects dynamic decoration of the field.

These and other objects and advantages of the present invention will no doubt become apparent to those of ordinary skill in the art after having read the following detailed description of the preferred embodiments which are illustrated in the several figures of the drawing.

IN THE DRAWING

DETAILED DESCRIPTION OF THE PREFERRED EMBODIMENT

Figure 1:
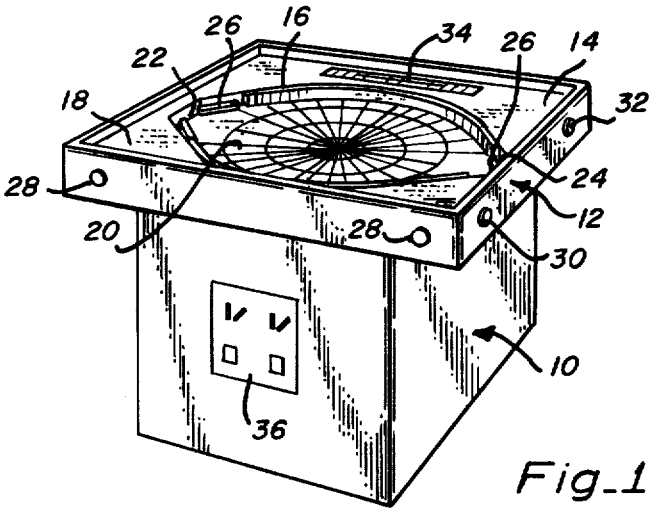
FIG. 1 is a perspective view illustrating a two-player position pinball game in accordance with the present invention.

Referring now to FIG. 1 of the drawing, there is shown a free-standing embodiment of the present invention which includes a base and electronics housing 10, and a game table 12 having a transparent plate glass upper surface 14. Positioned beneath the glass plate is a translucent molded plastic game top 16 having an upper-level surface 18 and an oval-shaped lower-level surface 20 that is suitably contoured and marked to form the game playing field as will be further described below. At opposite ends of the playing field are goal regions 22 and 24, respectively, each of which is equipped with a spaced-apart pair of flippers 26 that are used by a player to both protect his goal and effect offensive driving of a steel game ball disposed to roll on surface 20.

The flippers are controlled by buttons 28 provided on each side of the table 12 near the ends thereof. Along the end surfaces of the table are ball eject buttons 30 and credit buttons 32. Along one side of the table top is an annunciator panel 34 which, as will be more fully described below, indicates player score, game status, etc. The annunciator panel is viewable through the glass top 14. On one side of the base 10 is a coin receptacle 36 which includes the standard coin insert slots, return slots and reject buttons.

Figure 2:
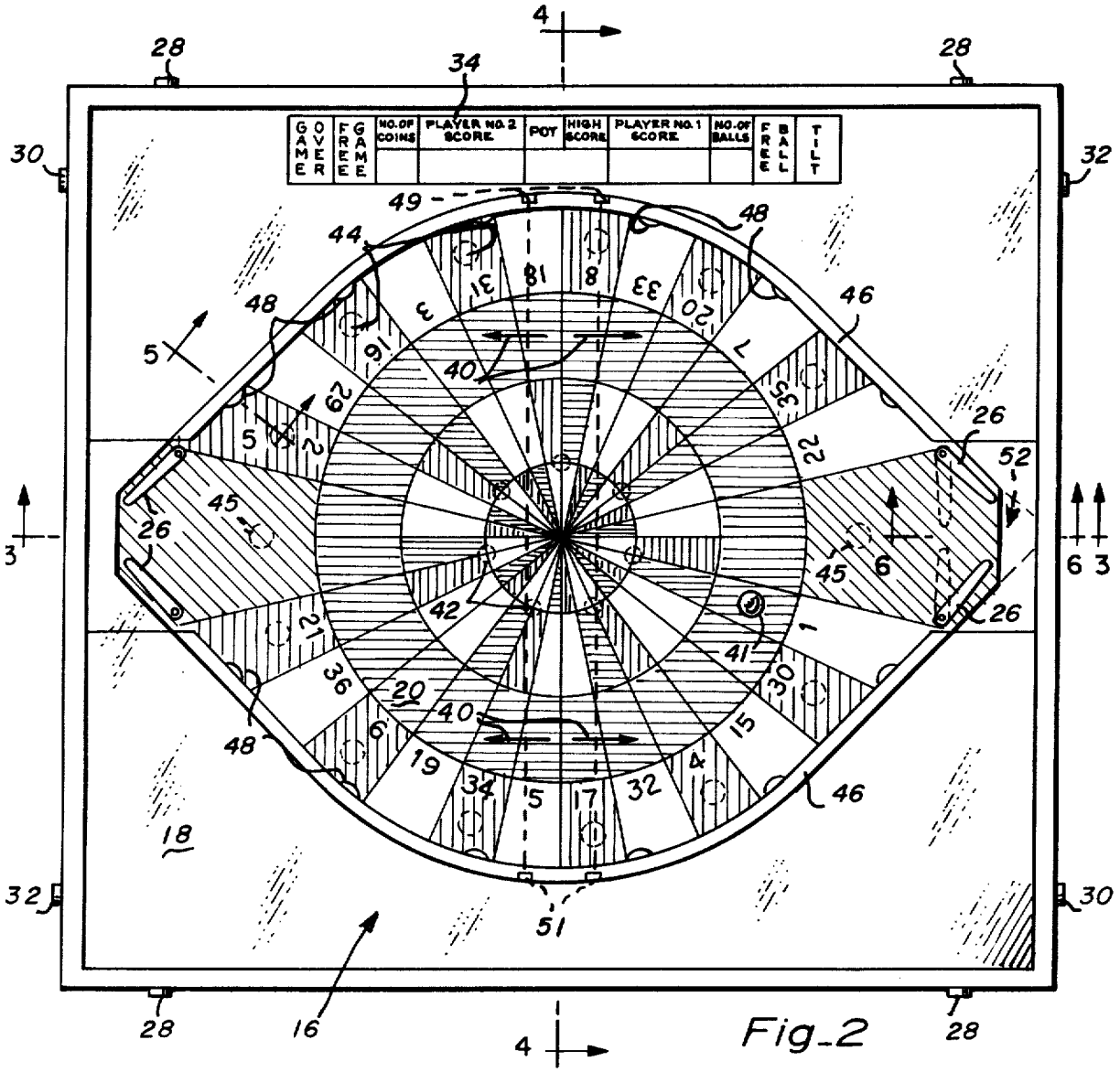
FIG. 2 is a top plan view of the two-position game shown in FIG. 1.
Figure 3:
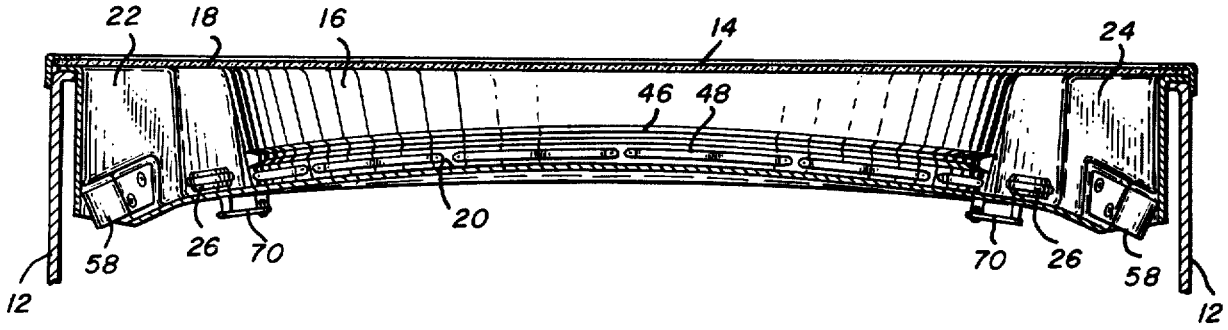
FIG. 3 is a partial cross section taken along the line 3—3 of FIG. 2.
Figure 4:
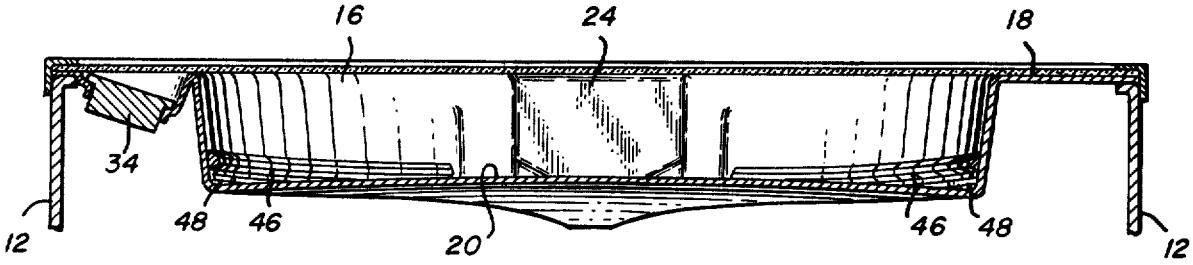
FIG. 4 is a partial cross section taken along the line 4—4 in FIG. 2.

In FIG. 2 of the drawing a plan view of the top of the table 12 is shown illustrating in detail the various features of the playing field and annunciator panel. As was pointed out above, the top 16 is a molded, generally dual level translucent plastic sheet having an upper surface 18 and a lower playing surface 20. As indicated by the arrows 40, and as further illustrated in FIGS. 3 and 4, the playing surface 20 is somewhat domed and formed so as to slope from the middle toward each goal. Note the slight transverse curvature in the playing surface 20 shown in FIG. 4. This, of course, is to insure that the playing ball 41 always rolls toward one goal or the other so that it can be maintained in play by the flippers 26 without movement of the table.

It should perhaps be pointed out that although the perimeter of the domed playing field is illustrated and described herein as being oval, it could be provided in any curved, circular or elliptical configuration. The important point is that it provide a barrier against which the ball 41 can roll under the influence of centrifugal force and one which will provide a path that will ultimately lead the ball back to the player driving it unless (1) the ball is not given enough energy to return to the driving player's goal area or (2) the opposing player strikes it with his flippers.

The surface 20 is appropriately decorated to increase the aesthetic effect of the game. In the preferred embodiment, a decal having various radial and circular lines, colored areas, numerals, etc., suggestive of a roulette wheel is affixed to the surface 20. An inner circle of lights illustrated by the dotted lines 42 and an outer circle of lights illustrated by the dotted lines 44 are disposed beneath the translucent playing surface and are powered sequentially in a fashion which creates the illusion of a rotating roulette wheel. More specifically, the simulated roulette effect is accomplished by sequencing the outer circle of lights 44 so that they appear to be rotating in one direction while at the same time sequencing the inner band of lights 42 so that they appear to be rotating in the opposite direction.

Figure 5:
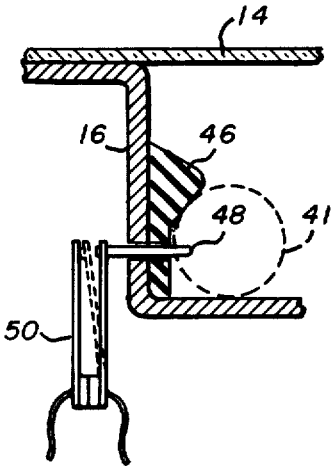
FIG. 5 is a partial cross section taken along the line 5—5 in FIG. 2.

Affixed to the oval sidewall joining upper surface 18 and lower surface 20 are bumper strips 46 which extend from flipper to flipper on each side of the playing field and serve to cushion the impact of the relatively heavy ball as it strikes the sides. The cross-sectional configuration of the bumper strip is illustrated in FIG. 5 of the drawing. Extending through openings in the vertical wall of top 16 and through bumper strip 46 are ball-engaging loops 48, each of which is attached to one contact of a scoring switch 50. The loops 48 extend outwardly into the playing field far enough so that as the ball rolls around the playing field perimeter in contact with bumper 46 and engages the loops 48, it causes the contact 50 to close and notify the computer of ball contact.

Note that in the preferred embodiment there are six scoring contact assemblies 48 arranged around each side of the playing field. However, it is of course to be understood that more or less such contact assemblies could be utilized. Although the playing points allocated to a single closure of any particular switch is arbitrary, in the preferred embodiment a number of points corresponding to the cumulative total of the numbers appearing on each side of the switch position have been assigned to the respective switches. More particularly, the switch at the upper left-hand corner has a scoring value upon closure of 29 plus 2 or 31 points. The next switch in the clockwise direction has 4 plus 16 or 20 points, etc. Note that the total points assigned to switches diametrically opposite each other are identical. This makes similar ball play from either playing end score the same.

In addition to the two circular arrays of lights, there is also a light under each goal area as indicated by the dotted circles 45, and in accordance with the present invention, each time a goal is made the corresponding goal illuminating light is lit.

As was indicated above, two flippers 26 are provided at each goal and are movable into the positions shown by the dashed lines in response to the pressing of the flipper buttons 28. In order to insure that a skillful shot by an opponent has the possibility of scoring a goal, the flipper of each pair is positioned so that when actuated to full travel, these tips are separated by approximately two ball diameters.

Figure 6:
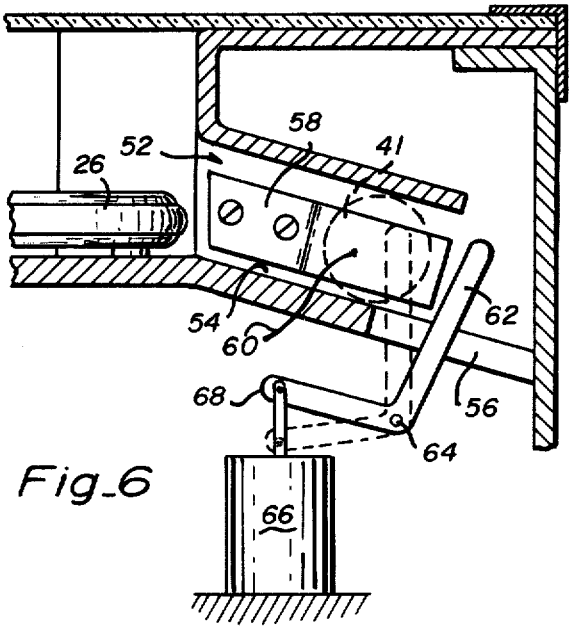
FIG. 6 is a partial cross section taken along the line 6—6 of FIG. 2.
Figure 7:
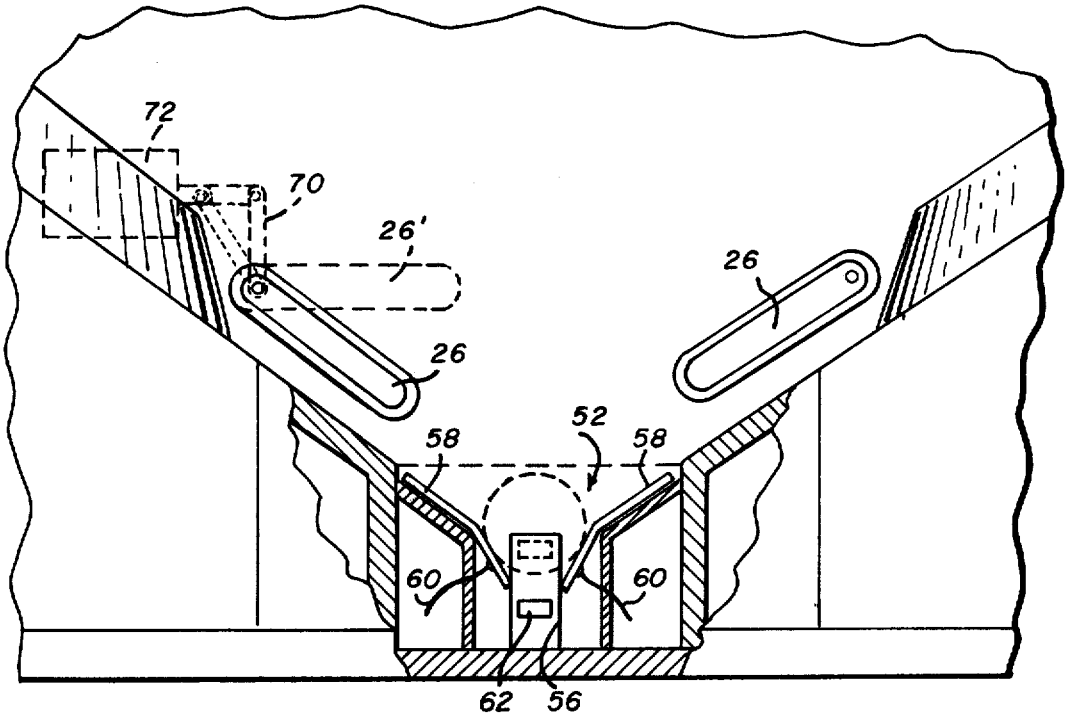
FIG. 7 is a partially broken top plan view of the section shown in FIG. 4.

Referring now to FIGS. 6 and 7 which are respectively enlarged cross-sectional and plan views of the goal regions, it will be noted that at each goal a ball retainer pocket 52 is formed by a more sloped floor 54 having a slot 56 provided therein, and a pair of metallic ball contact members 58 disposed on each side. By attaching electrical wires 60 to the members 58, the steel playing ball with short the two together and provide a means for indicating that a ball is within the goal pocket.

Extending up through the slot 56 is an ejector lever 62 which is pivotally attached to the table chassis at 64 and has a solenoid actuator 66 attached to a crank arm at its end 68. As is illustrated by the dashed lines, upon actuation of the solenoid 66, the distal end of the lever 62 will swing forward, engage a ball within the pocket and drive it outwardly back onto the playing field. The solenoids 66 are actuated by buttons 30 and the control electronics.

In FIG. 7 the flipper actuation mechanism is also illustrated and includes a lever arm 70, one end of which is rigidly attached to flipper 26, the other end of which is coupled to the armature of a solenoid actuator 72 such that when actuated, the solenoid causes the flipper 26 to rotate into the full travel position shown by the dashed lines 26'.

Returning now to FIG. 2, in the preferred embodiment the annunciator panel 34 is shown to include back lighted portions which indicate GAME OVER, FREE GAME, FREE BALL and TILT, and additional digital readout windows which indicate the NO. OF COINS, PLAYER NO. 1 SCORE, PLAYER NO. 2 SCORE, POT, HIGH SCORE and NO. OF BALLS left to play. These indicators are all controlled by computerized control electronics which will be described below.

Also included and generally illustrated in FIG. 2 are a pair of light sources 49 and photodetectors 51 which are positioned such that each source beam is interrupted by the passage of a playing ball from one goal side of the field to another and are used to indicate to the computer the direction in which the ball is traveling. Such information is used by the computer as a means of actuating one of the sets of flippers when the game is operated in a one-player-against-computer mode and as a means by which initiate reversal of apparent rotation of the rings of lights. More specifically, the aesthetic effect of the roulette-like rotation display is enhanced where the light rotation is opposite to the direction in which the ball is traveling around the perimeter of the playing field.

Figures 8, 9:
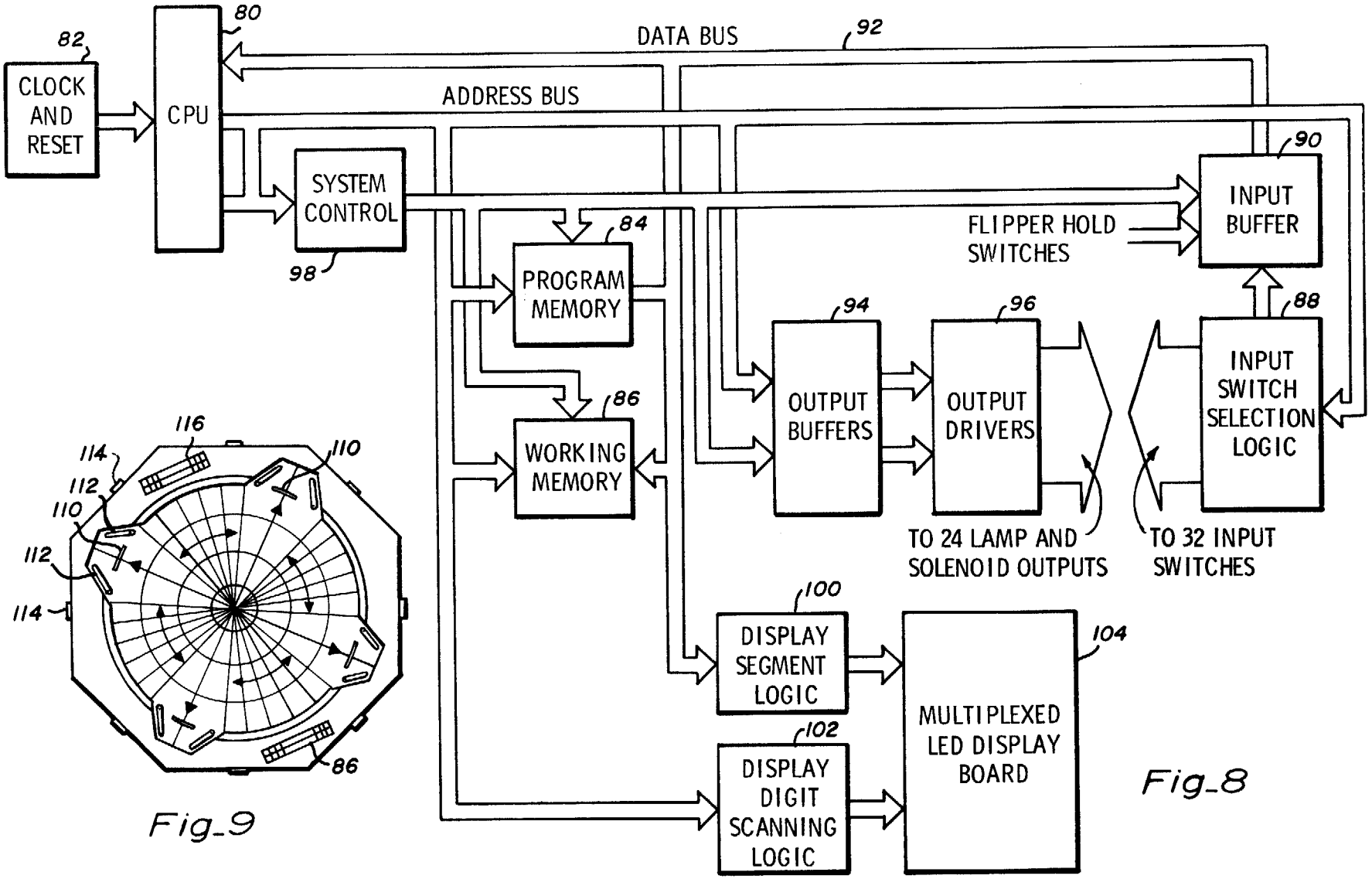
FIG. 8 is a block diagram illustrating the control electronics of the present invention.
FIG. 9 is a top plan view illustrating a four-player position alternative embodiment of a pinball game in accordance with the present invention.

The electronic game control system is schematically shown in block diagram form in FIG. 8 of the drawing and includes a central processing unit 80 which responds to clock and reset pulses generated by unit 82 and programs stored in the program memory 84 and working memory 86, and from data input from the input switch selection logic 88 through buffer 90 and data bus 92, to generate control signals. The control signals are coupled via output buffers 100 to output drivers 96 which in turn drive the lamp and solenoid outputs of the preferred embodiment.

In the illustrated system, there are 32 input switches which are selected by the input selection logic 88 for input to CPU 80. Such input switches includes those of the coin receptor 36, the bumper switches 48, the goal contacts 58, etc.

The system control circuitry 98 enables appropriate sections of the system to be operated at the correct times as determined by the system program and various input signals received. The input buffer 90 responds to an output from the system control 98 and allows data to be tested by the CPU from either the input switch selection logic, the flipper hold switches or the power ON reset logic.

The program memory 84 is a solid state permanent memory which contains program instructions for the CPU, while the working memory 86 provides temporary storage for date input and output from the CPU. The output buffers 94 provide temporary storage of CPU output commands which are used to enable the output drivers 96. The drivers 96 provide solid state control of all output devices through 24 outputs coupled to various combinations of the lamps 42 and 44 which are disposed beneath the playing surface, the flippers 26, and chimes (not shown).

The display segment logic 100 provides temporary storage, decoding, and driving of display segment information received from the CPU, while the display digit scanning logic 102 provides temporary storage, decoding, and driving of each display digit in the multiplex LED display board 104. The board 104 contains player readouts for scores and other information indicated on the panel 34 shown in FIG. 2. In the preferred embodiment, the use of a multiplexed LED display lowers the power requirements of the display.

As was indicated above, in order to protect the flipper actuating solenoids 72 from overheating, as might happen if one were to hold a flipper button 28 down for an extended period of time, the flipper solenoids are also controlled by the CPU in response to an input from the manually-operated flipper actuating buttons 28 and such input is coupled to the CPU through the input buffer 90 and the data bus 92.

In operation, when the power is turned on, the display panel 34 is illuminated with zeros in the PLAYER SCORE windows, the NO. OF COINS window, the NO. OF BALLS window, and the POT value window. However, where a high score is maintained in the memory, the middle window will switch back and forth between the HIGH SCORE and the POT value. Also, the play field lights 42 and 44 begin sequencing in oppositely-directed rotary fashion. Upon insertion of coins into the receptor 36, the number of such coins will be reflected in the appropriate window of panel 34. At the same time, the NO. OF BALLS window will be lit to indicate the number of balls available for one play session.

The game is started by pressing one of the ball eject buttons 30 so as to cause a ball to be ejected into the play field. Since the play field is sloped from its center toward both goals, the ball will roll toward one or the other of the goal areas and will be kept in play by the players by use of the flippers 26. Each time the ball rolls around the perimeter and strikes one of the scoring switch loops 48, the POT value will increase and a chime will ring. When the ball is eventually hit into one of the goals, that goal area will flash as one of the lights 45 is lit, and the digits in the SCORE window of the scoring player will increment upwardly to include the pot value as the pot value digits begin counting back down to zero. Furthermore, each time a goal is scored, the apparent rotation of the two rings of lights is changed. The balls remaining in play (NO. OF BALLS) display is also decremented by pressing the ball eject button 38 and another ball is ejected into play. The sequence is then repeated until all balls have been played. In the event that during the game play a particular preset pot value or score value is exceeded, a free game will be awarded. The game ends when the balls remaining display reaches zero.

In the event that an included tilt switch (not shown) is actuated, the flippers will be inactivated and when the ball enters one of the goals, the points scored will go to zero and and balls remaining display (NO. OF BALLS) will decrement. Thereafter, a ball will be ejected onto the playing field and play will be resumed. When the game is over, the computer will load a new HIGH SCORE, if appropriate, the goal lights will turn off and the GAME OVER light will flash.

In the case where a single coin is inserted into the receptor 36 indicating a new player mode of operation, the control electronics will cause the unoccupied goal area flippers 26 to flip several times each time a ball is hit by one of the player's flippers and passes toward the unmanned goal and through the light beams generated by sources 49. If the ball is struck by one of the flippers of the unmanned goal, it will of course be returned back to the other side of the field just as if that goal had been occupied, and play will continue as if it were so manned. All other functions of the operation will remain the same. The advantages of this alternative play mode are obvious in that it allows single play or competitive play at the option of the players.

Although the embodiment illustrated in FIGS. 1-6 includes only two goal positions, it is contemplated that an equally interesting game can be provided using three or more player positions. One such implimentation including four player positions is illustrated in FIG. 9. In this embodiment, the principal differences are that the playing field is either domed or contoured with at least four directions of slope, such that the field surface in each quadrant slopes toward the associated goal area, and ball blocking pop-ups 110 are provided at each goal area so as to block those goal areas which are not manned by a player. This allows any combination from one player to four to compete against each other. As in the previous embodiment, flippers 112 are provided at each goal area and flipper buttons 114 are provided at convenient locations on each side of the goal area. For the convenience of the players, dual annunciator panels 116 may also be incorporated into the tops of the table.

Whereas the present invention has been described above in terms of two presently preferred embodiments, it is contemplated that other alterations and modifications may become apparent to those skilled in the art after having read the above disclosure. It is therefore intended that the appended claims be interpreted as covering all such alterations and modifications as fall within the true spirit and scope of the invention.

What is claimed is:

1. Pinball game apparatus comprising:

means defining a horizontally disposed domed playing field surface having a center and a generally oval-shaped perimeter with at least two goal areas provided on opposite sides thereof, such playing field surface being formed so that all areas thereof slope continuously from said center and toward an associated one of said goal areas, a curvature of said surface transverse of said goal areas being less than a curvature of said surface between the goal area;

a ball disposed to roll upon said playing field surface, the curvatures of said playing field surface insuring that said ball always rolls toward one or the other of said goal areas;

plural ball restraining barrier means disposed around the perimeter of said playing field surface, each barrier means forming a continuous, curved barrier against which said ball can roll and arranged extending between adjacent sides of said goal area;

score accumulating and display means;

a plurality of ball sensing devices disposed along said barrier and coupled to said score accumulating and display means so as to send a scoring signal thereto each time the presence of said ball is detected by one of said devices;

flipper means disposed in front of each said goal area for allowing a player to strike the ball and drive it away from his goal area in a tangential direction relative to said barrier for rolling the ball under centrifugal force along said barrier and around the perimeter of said playing field; and ball sensing means disposed within each goal area and coupled to said score accumulating and display means so as to send a goal signal thereto each time the ball passes behind said flipper means and into one of said goal area.

2. Pinball game apparatus as recited in claim 1 wherein said score accumulating and display means includes electronic logic circuitry capable of accumulating each said scoring signal until a goal signal is received from one of said ball sensing means and thereafter causing the accumulated signal to be credited to the score of the player at the opposite goal.

3. Pinball game apparatus as recited in claims 1, or 2 wherein each said goal area is provided with a receptacle for receiving said ball and means for ejecting the received ball back onto said playing field.

4. Pinball game apparatus as recited in claim 2 wherein said score accumulating and display means includes means for displaying a score presently being accumulated and means for displaying the present score of each player.

5. Pinball game apparatus as recited in claim 4 and further including means for detecting passage of said ball from one side of said playing field to another and for actuating the flipper means disposed at one of said goal areas when said ball moves in the direction of such goal area.

6. Pinball game apparatus as recited in claims 1, or 2 wherein said score accumulating and display means includes means for displaying a score presently being accumulated and means for displaying the present score of each player.

7. Pinball game apparatus as recited in claims 1, or 2 and further including means for detecting passage of said ball from one side of said playing field to another and for actuating the flipper means disposed at one of said goal areas when said ball moves in the direction of such goal area.

8. Pinball game apparatus as recited in claim 7 wherein said means for detection includes a plurality of light source plus photo detector combinations, each combination having a light beam passing from said light source to said photo detector, said combinations being arrayed about the perimeter of said playing surface in such a manner as to detect the passage of said ball through the interruption of said light beam by said ball.

9. Pinball game apparatus as recited in claim 1, or 2 and further including means for dynamically illuminating certain regions of said playing field in a predetermined manner.

10. Pinball game apparatus as recited in claim 9 wherein said means for illuminating includes a first plurality of light sources arrayed around the perimeter of said playing field and a second plurality of light sources arrayed proximate to and around the center of said playing field.

11. Pinball game apparatus as recited in claim 10 wherein said playing field surface is translucent and wherein said light sources are disposed therebeneath.

12. Pinball game apparatus as recited in claims 1, or 2 wherein said means defining said playing field surface is a unitary member having a flat upper surface disposed at a height higher than the level of said playing field surface and having vertical walls coupling said playing field surface to said upper surface and defining said oval-shaped perimeter.

13. Pinball game apparatus as recited in claim 12 wherein said unitary member is translucent and wherein light sources are disposed beneath said playing field surface to illuminate said playing field surface.

* * * * *